United States Patent [19]

Elkin

[11] Patent Number: 4,899,971

[45] Date of Patent: Feb. 13, 1990

[54] DISPLAY ASSEMBLY

[75] Inventor: Alfred A. Elkin, Pawtucket, R.I.

[73] Assignee: Plastic Development, Inc., Pawtucket, R.I.

[21] Appl. No.: 227,067

[22] Filed: Aug. 1, 1988

[51] Int. Cl.[4] ..... A47F 5/08

[52] U.S. Cl. ..... 248/225.1; 248/225.2; 248/221.3; 211/88; 211/94

[58] Field of Search ..... 248/225.5, 225.2, 221.3, 248/311.2, 220.2, 224.4, 224.3; 211/71, 94, 94.5, 162, 88; 206/464, 465, 476; 220/18, 85 H; 312/234.4, 321, 246

[56] References Cited

U.S. PATENT DOCUMENTS

| | | | |
|---|---|---|---|
| 2,971,653 | 2/1961 | Shaw | 211/72 |
| 3,189,187 | 6/1965 | Guyer Jr. et al. | 211/71 |
| 3,698,565 | 10/1972 | Weber | 248/301 X |
| 4,133,507 | 1/1979 | Chervenak | 248/225.2 |
| 4,160,570 | 7/1979 | Bridges | 220/18 X |
| 4,300,692 | 11/1981 | Moreno | 248/221.3 X |
| 4,352,478 | 10/1982 | Loew | 248/221.3 |
| 4,457,436 | 7/1984 | Kelley | 211/94 X |

*Primary Examiner*—Ramon S. Britts

*Assistant Examiner*—Karen J. Chotkowski

*Attorney, Agent, or Firm*—Salter & Michaelson

[57] ABSTRACT

A display assembly includes a channel member which is adapted to be received in a substantially horizontal, upwardly facing disposition on a supporting surface, a hanger member which is receivable in engagement with the channel member and a package member which is receivable on the hanger member and operative for supporting and displaying an item in front of the supporting surface. The hanger member includes an engagement portion which is receivable in engagement with the hanger member and at least one arm which extends outwardly from the engagement portion, and the package member is receivable on the arm of the hanger member. In a first embodiment of the display assembly the package member comprises a display box which is releasably receivable on the arm and operative for supporting and displaying an item contained in the box. In a second embodiment of the display assembly, the package member comprises a package such as a display card which is receivable on the hanger member so that it is operative for displaying an item in front of the supporting surface.

12 Claims, 2 Drawing Sheets

DISPLAY ASSEMBLY

BACKGROUND AND SUMMARY OF THE INVENTION

The instant invention relates to retail display apparatus and more particularly to a display assembly for supporting and displaying items, such as jewelry items in front of a substantially vertical supporting surface.

While a variety of different types of display apparatus have been heretofore available for displaying relatively small items, such as relatively small jewelry items and the like, most of the heretofore available display apparatus have lacked sufficient versatility to enable them to be effectively utilized for supporting relatively small items in small display boxes in front of substantially vertical supporting surfaces. For this reason, heretofore it has generally been necessary to either display relatively small items on display cards or the like, or to support them on counter tops or shelves. However since displays which are supported on substantially vertical surfaces generally make more efficient use of space than other types of displays; and since it is often preferable to display relatively small items in individual display boxes, the heretofore available displays for relatively small items, such as jewelry items have not always been satisfactory.

The instant invention provides a highly effective display assembly which is adapted to be supported on a substantially vertical supporting surface and which is operative for supporting one or more relatively small items in individual packages or boxes in front of the supporting surface. Specifically, a first embodiment of the display assembly of the instant invention comprises a channel member which is adapted to be mounted in a substantially horizontal upwardly facing disposition on a substantially vertical supporting surface, a hanger member which is receivable in engagement with the channel member and a package member which is receivable on the hanger member and operative for containing and supporting an item for display in front of the supporting surface. The channel member preferably includes a pair of spaced inner and outer walls, and a lip on the inner side of the outer wall which cooperates with the inner wall to define a reduced mouth in the channel member. The hanger member preferably includes an engagement portion which is receivable in the channel member so that it is retained in engagement therewith by the lip on the outer wall, and an arm portion which extends outwardly and preferably upwardly from the channel member when the hanger member is received in engagement therein. The engagement portion of the hanger member preferably includes a resilient latch element which is engageable with the lip to retain the engagement portion in engagement with the channel member and a downwardly extending leg which is engageable with the inner wall to retain the latch element in engagement with the lip. The package member preferably comprises a substantially rigid box having a bottom portion and a cover portion which is hingeably attached to the bottom portion so that it is movable between a closed position wherein it is received in covering relation on the bottom portion and an upwardly hinged open position. The box is preferably adapted so that when it is received on the arm portion the bottom portion of the box extends downwardly and outwardly from the channel member. Further, the hanger member preferably includes a plurality of arm portions, and the bottom portion of the box preferably has a plurality of upwardly extending apertures therein which are adapted for receiving the arm portions of the hanger member in order to more effectively detachably secure the box to the hanger member.

A second embodiment of the display assembly of the instant invention includes a channel member of the type hereinabove set forth and a package hanger member which is receivable in engagement with the channel member and operative for receiving and supporting a package such as a display card in front of a supporting surface. The package hanger member includes a dish-shaped engagement portion which is receivable in engagement in an inverted disposition on the channel member and an arm which extends outwardly from the engagement portion for supporting the package in front the a supporting surface.

It has been found that the display assembly of the subject invention can be effectivley utilized for supporting and displaying one or more items, in front of a substantially vertical supporting surface. More specifically, it has been found that the display assembly of the subject invention can be effectively utilized for displaying items, such as jewelry items or the like in relatively small boxes in front of a substantially vertical supporting surface in a manner which permits the boxes and the items contained therein to be easily detached or removed from the supporting surface when desired. Further, because the display assembly of the subject invention includes an elongated channel member, it can also be utilized for supporting other types of display packages, including conventional jewelry display cards.

Accordingly, it is a primary object of the instant invention to provide an effective display assembly for supporting a display box in front of a substantially vertical supporting surface.

Another object of the instant invention is to provide an effective and efficient display assembly for displaying a jewelry item in a jewelry box.

An even further object of the instant invention is to provide an effective display assembly comprising an elongated channel member which is adapted to be mounted in a substantially horizontal upwardly facing disposition on a supporting surface, a hanger member which is receivable in the channel member, and a package member which is receivable on the hanger member and operative for containing an item of jewelry for display.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
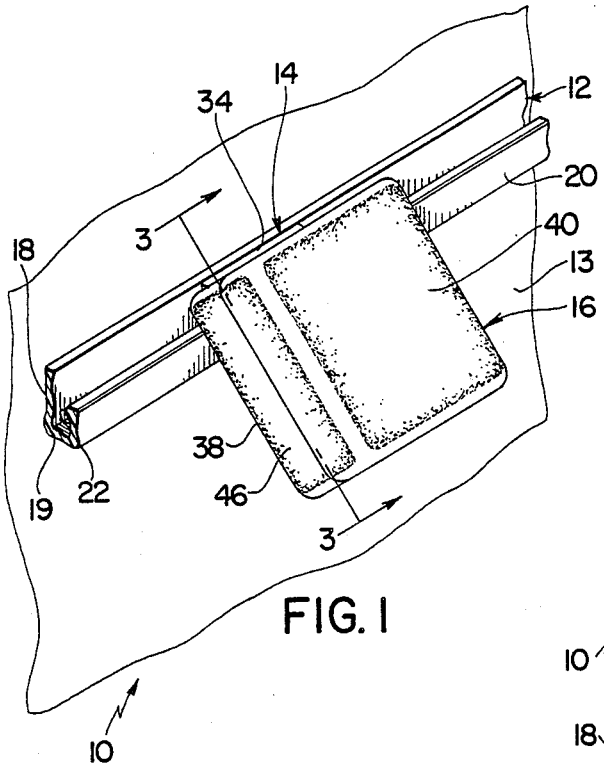
FIG. 1 is a perspective view of a first embodiment of the display assembly of the subject invention with the display box in a closed position.
Figure 2:
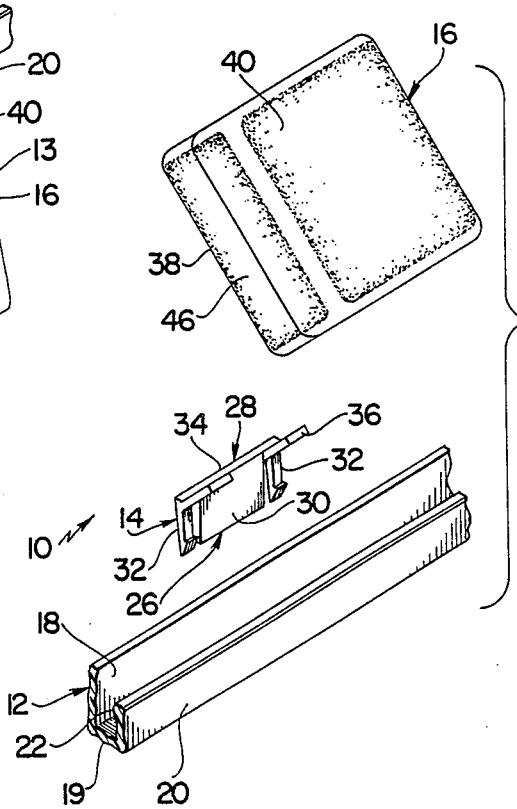
FIG. 2 is an exploded perspective view thereof.

Referring now to the drawings, a first embodiment of the display assembly of the instant invention is illustrated in FIGS. 1–5 and generally indicated at 10 in FIGS. 1–4. The display assembly 10 comprises an elongated channel member generally indicated at 12 which is securable to a substantially vertical supporting surface 13, a hanger member generally indicated at 14, which is receivable in engagement with the channel member 12, and a package member or box generally indicated at 16 which is receivable on the hanger member 14 so that the box 16 is supported in front of the supporting surface 13.

Figure 3:
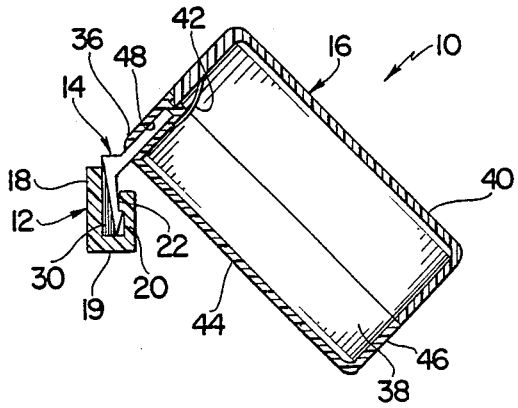
FIG. 3 is a sectional view taken along line 3—3 in FIG. 1.
Figure 4:
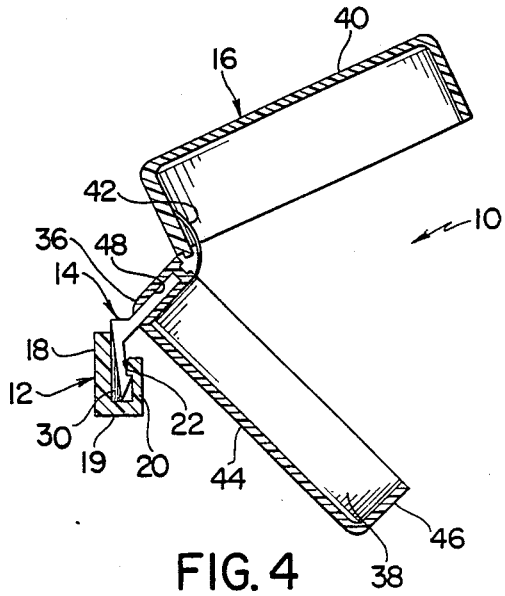
FIG. 4 is a similar view with the box in an open position.
Figure 5:
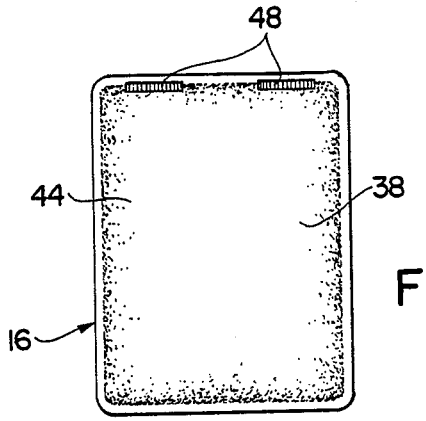
FIG. 5 is a bottom plan view of the jewelry box portion of the display assembly.

The channel member 12 is preferably extruded from a plastic material, such as an acrylic plastic, and it is adapted to be mounted in a substantially horizontal upwardly facing disposition on the supporting surface 13. As illustrated most clearly in FIGS. 2 and 3, the channel member 12 is of generally J-shaped sectional configuration and it comprises an inner wall 18 having a substantially flat rear surface a bottom wall 19, an outer wall 20 and a lip 22 which is formed on the inner side of the outer wall 20 adjacent the upper end thereof. The inner wall 18 and the outer wall 20 are integrally joined by the bottom wall 19 so that the inner and outer walls 18 and 20, respectively, are substantially parallel and so that the lip 22 cooperates with the inner wall 18 to define a reduced mouth in the channel member 12. The lip 22 is preferably formed with a substantially sharp lower edge as illustrated in FIGS. 3 and 4, in order to enable it to be effectively utilized for retaining the hanger member 14 in engagement with the channel member 22 as will hereinafter be more fully set forth.

The hanger member 14 is preferably integrally molded from a suitable plastic material, such as a polycarbonate, and it includes an engagement portion generally indicated at 26 and a hanger portion generally indicated at 28. The engagement portion 26 includes a substantially flat, downwardly extending resilient leg 30 and a pair of downwardly extending resilient latch elements 32 which are disposed on opposite sides of the leg 30. The latch elements 32 and the leg 30 are integrally attached to the hanger portion 28, although the latch elements 32 extend slightly angularly forwardly relative to the leg 30 as illustrated most clearly in FIGS. 3 and 4. The engagement portion 26 is constructed so that it is detachably receivable in interlocked engagement in the channel member 12 with the latch elements 32 engaging the bottom side edge of the lip 22 to retain the hanger member 28 in the channel member 12. The hanger member 14 is further constructed so that the leg 30 is slightly resiliently deflectable relative to the latch elements 32 in order to enable the latch elements 32 to be disengaged from the lip 22 for removing the hanger member 14 from the channel member 12. The hanger portion 28 comprises a cross bar 34 to which the leg 30 and the latch elements 32 are attached, and a pair of arm portions 36 which project angularly upwardly and forwardly from the cross bar portion 34 as also illustrated most clearly in FIGS. 3 and 4. The hanger portion 28 is adapted so that when the channel member is mounted in a substantially horizontal upwardly facing disposition and the engagement portion 26 is received in the channel member 12, the arms 36 project forwardly and upwardly from the channel member 12 as illustrated in FIGS. 3 and 4.

The box member 16 comprises a bottom portion 38, a cover portion 40 and a resilient metal hinge spring 42. The bottom portion 38 is of generally rectangular configuration and it includes a bottom wall 44 and an upstanding sidewall 46, and a pair of spaced apertures 48 extend upwardly from the bottom wall 44 into the side wall 48 adjacent the rear end of the bottom portion 38, the apertures 48 being formed as integrally molded sleeves which are dimensioned and positioned for receiving the arms 36 therein. The cover portion 40 is also of generally rectangular configuration, and it is dimensioned to be received in covering relation on the bottom portion 38 in the manner illustrated in FIGS. 1–3. The hinge spring 42 is of conventional construction and it is adapted to hingeably connect the cover portion 40 to the bottom portion 38 so that the box 16 is hingeable between the closed position illustrated in FIG. 3 and the open position illustrated in FIG. 4. The box 16 is adapted for receiving and supporting various items, such as jewelry items, for display. In this connection, however, it will be understood that the use of various conventional inserts in the box 16 in order to further adapt it to receive and support various jewelry items therein is contemplated.

For use of the display assembly 10, the channel member 12 is preferably secured on a substantially vertical supporting surface with a suitable adhesive so that it is in a substantially horizontal, upwardly facing disposition such as illustrated in FIGS. 1–4. The hanger member 14 can then be inserted into the channel member 12 so that the latch elements 32 engage the lip 22 and the leg 30 engages the rear wall 18 in order to retain the hanger member 14 in the channel member 12. The box 16 can then be assembled on the hanger portion 28 of the hanger member 14 so that the arms 36 are received in the apertures 48. When the box 16 is assembled on the hanger member 14 in this manner, the box 16 extends generally downwardly and outwardly from the channel member 12 so that the cover portion 40 is upwardly hingeable to the open position thereof without engaging the supporting surface 13 and so that a jewelry item contained in the bottom portion 38 can be effectively displayed in the bottom portion 38. The hanger member 14 can be moved laterally in the channel member 12 to horizontally reposition the box 16 on the supporting surface 13, and the box 16 can be removed from the hanger member 14 by sliding the bottom portion 38 upwardly and off the arms 36.

Figure 6:
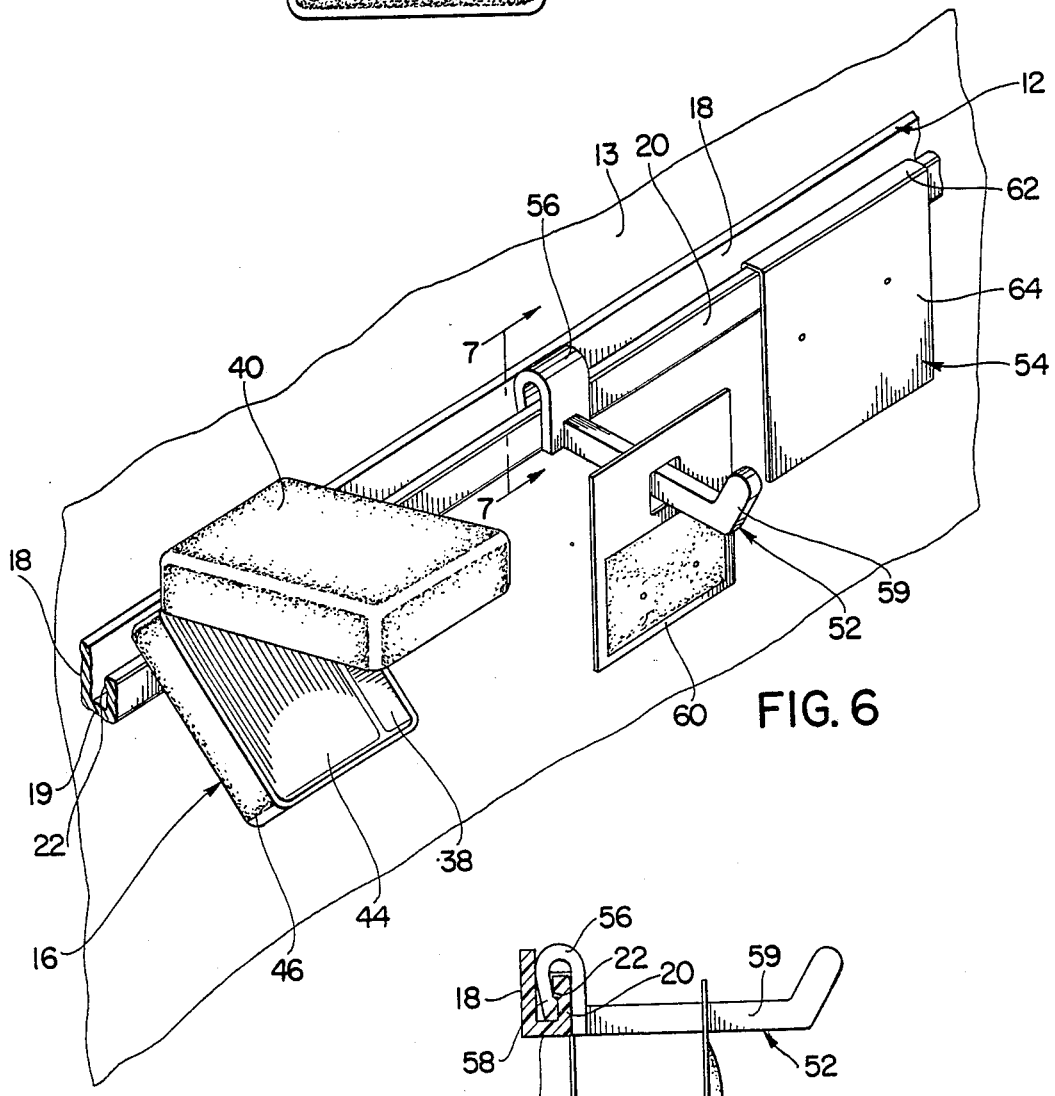
FIG. 6 is a perspective view of a second embodiment of the display assembly.
Figure 7:
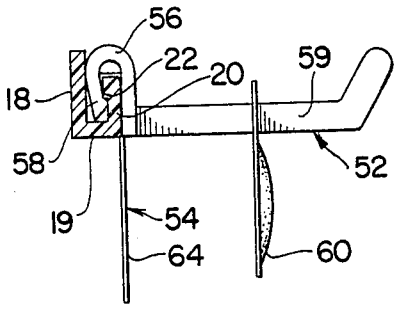
FIG. 7 is a sectional view taken along line 7—7 in FIG. 6.

A second embodiment of the display assembly of the instant invention is illustrated in FIGS. 6 and 7 and generally indicated at 50. The display assembly 50 includes a channel member 12, a hanger member 14, a box 16 on the hanger member 14 a package hanger member generally indicated at 52 and a display card 54. The channel member 12, the hanger member 14 and the box 16 in the display assembly 50 are substantially the same as their corresponding components in the display assembly 10. The package hanger member 52 is preferably molded from a suitable plastic material and it includes a generally U-shaped engagement portion or clip element 56 which is receivable in engagement in an inverted disposition with the outer wall 20 for detachably retaining the package hanger member 52 thereon. In this regard, the U-shaped clip element 56 is preferably formed so that the opposite sides thereof converge slightly and the rear side thereof is preferably formed as inwardly facing latch 58 thereon which is engageable with the lip 22 on the channel member 12. The clip element 56 is, however, formed so that the opposite sides thereof are slightly resiliently separable for disengaging the hanger member 52 from the channel member 12. The hanger member 52 further includes a hanger arm 59 which extends outwardly from the clip element 56 and then upwardly and is adapted for receiving various packages, such as the display card 60 in order to display items mounted thereon in front of the surface 13. The display card 54 is of conventional construction and it includes integrally formed hanger and card portions 62 and 64, respectively. The display card 54 is preferably extruded from a suitable plastic and it is adapted for receiving various jewelry items, such as earrings or pins, thereon for display. The display assembly 50 is also adapted to be mounted on a substantially vertical supporting surface 13 and it can be effectively utilized for supporting a variety of different types of items and packages as illustrated.

It is seen, therefore, that the instant invention provides an effective display assembly for displaying various articles, such as jewelry items and the like, in front of a substantially vertical supporting surface. The jewelry box 16 can be effectively supported on the channel member 12 with the hanger member 14 so that items contained in the box 16 can be effectively displayed in front of the supporting surface 13 in a manner which nevertheless permits the box 16 to be easily removed from the hanger member 14. The package hanger member 52 and the display card 54 can also be effectively supported in front of the supporting surface 13 with the channel member 12. Accordingly, it is seen that the display assemblies 10 and 50 represent significant advancements in the art which have substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A display assembly comprising:

(a) a channel member adapted to be mounted in a substantially horizontal, upwardly facing disposition on a substantially vertical supporting surface, said channel member including spaced inner and outer walls and an inner lip on the inner side of one of said inner or outer walls which cooperates with the other of said inner or outer walls to define a reduced mouth of said channel member;

(b) a hanger member including an engagement portion and an arm portion, said engagement portion being detachably snap received in said channel member and including a downwardly extending resilient leg and a downwardly extending resilient latch element adjacent said leg, said latch element engaging said lip to retain said engagement portion in releasable interlocking engagement in said channel member, said downwardly extending leg engaging the one of said inner or outer walls which is opposite from said lip to retain said latch element in engagement with said lip, said arm portion being attached to said leg and extending outwardly from said channel member and said supporting surface when said channel member is mounted on said supporting surface; and (c) a package member received on said arm portion and operative for containing an item for display in front of said supporting surface.

2. In the display assembly of claim 1, said lip being disposed on the inner side of said outer wall.

3. In the display assembly of claim 1, said package member further characterized as a substantially rigid box.

4. In the display assembly of claim 3, said box further characterized as including a bottom portion, and a cover portion, and mean hingeably attaching said top portion to said bottom portion, said cover portion being hingeable between a closed position wherein it is received in covering relation on said bottom portion and an upwardly hinged open position, said bottom portion extending outwardly and downwardly from said supporting surface.

5. In the display assembly of claim 3, said arm portion extending outwardly and upwardly from said channel member.

6. In the display assembly of claim 3, said box having an elongated aperture therein, said arm portion being received in said aperture for supporting said box.

7. In the display assembly of claim 4, said box bottom portion having an elongated aperture therein which extends upwardly from the bottom end thereof, said arm portion being received in said aperture for supporting said box.

8. In the display assembly of claim 7, said box bottom portion having a plurality of said apertures therein which extend upwardly in spaced, substantially parallel relation from the bottom end thereof, said hanger member further comprising a plurality of said arm portions, each of said arm portions being received in one of said apertures.

9. A display assembly comprising a hanger member including an engagement portion and an arm portion, channel means receivable on a substantially vertical supporting surface and operative for detachably receiving and supporting said hanger member thereon so that said engagement portion is releasably received in said channel means, said arm portion being attached to said engagement portion and extending angularly upwardly and outwardly therefrom when said engagement portion is received in said channel means and a substantially rigid box including a bottom portion having a bottom wall and an upstanding rear wall, said box having an aperture therein which extends upwardly through said bottom wall along said rear wall, said arm portion being releasably received in said aperture for supporting said box in front of said supporting surface in a disposition wherein said bottom wall extends angularly downwardly and outwardly from said channel means.

10. In the display assembly of claim 9, said box bottom portion having a plurality of said apertures therein which extend upwardly in spaced, substantially parallel relation from the bottom wall thereof, said hanger member further comprising a plurality of said arm portions, each of said arm portions being received in one of said apertures.

11. In the display assembly of claim 9, said box further including a top portion and hinge means hingeably attaching said top portion to said bottom portion along said rear wall so that said top portion is alternatively retained in an open position wherein said top portion extends angularly upwardly from said bottom portion and a closed position wherein said top portion is received in covering relation on said bottom portion.

12. In the display assembly of claim 9, the rear wall of said box extending substantially perpendicularly upwardly from the bottom wall thereof and extending angularly outwardly and upwardly from said channel means.

* * * * *